US007506420B2

(12) United States Patent
Frydlewski

(10) Patent No.: US 7,506,420 B2
(45) Date of Patent: Mar. 24, 2009

(54) FOOTWEAR AND CLOTHES FASTENING AND TRANSFORMING SYSTEM

(76) Inventor: Gaston Frydlewski, Maure 1570 3rd floor apartment A, Capital Federal-Buenos Aires (AR) 1426

( * ) Notice: Subject to any disclaimer, the term of this patent is extended or adjusted under 35 U.S.C. 154(b) by 365 days.

(21) Appl. No.: 11/162,759

(22) Filed: Sep. 21, 2005

(65) Prior Publication Data

US 2006/0254089 A1 Nov. 16, 2006

(30) Foreign Application Priority Data

Jul. 23, 2004 (AR) ..... 040102634

(51) Int. Cl.
*A44B 21/00* (2006.01)

(52) U.S. Cl. ..... 24/713; 24/713.1

(58) Field of Classification Search ..... 24/712, 24/714.7, 713.6, 715.3, 713, 713.1; 36/50.1, 36/51, 52

See application file for complete search history.

(56) References Cited

U.S. PATENT DOCUMENTS

| | | | | | |
|---|---|---|---|---|---|
| 146,913 | A | | 1/1874 | Keith | |
| 315,819 | A | * | 4/1885 | Naylon | 267/74 |
| 562,114 | A | | 6/1896 | Benford | |
| 565,884 | A | | 8/1896 | Emmons | |
| 715,599 | A | * | 12/1902 | Pitts | 24/713.1 |
| 1,055,118 | A | * | 3/1913 | Zieglr | 2/228 |
| 1,184,647 | A | | 5/1916 | Holloway | |
| 1,458,088 | A | * | 6/1923 | Unnold | 24/713 |
| 1,595,630 | A | | 8/1926 | Stockton | |
| 1,678,241 | A | * | 7/1928 | Benz | 36/50.1 |
| 1,934,455 | A | | 11/1933 | Staude et al. | |
| 1,966,135 | A | | 7/1934 | Reh | |
| 2,264,644 | A | | 12/1941 | Santangelo | |
| 2,289,225 | A | | 7/1942 | Tonai | |
| 2,689,991 | A | | 9/1954 | Fedankiw et al. | |
| 2,871,537 | A | | 2/1959 | Hickerson | |
| 3,193,950 | A | | 7/1965 | Liou | |
| 3,701,572 | A | | 10/1972 | Velasquez | |
| 3,731,350 | A | | 5/1973 | Diebold | |
| 5,230,171 | A | | 7/1993 | Cardaropoli | |
| 5,239,732 | A | | 8/1993 | Steven | |
| 5,465,442 | A | | 11/1995 | Merser | |
| 5,692,276 | A | | 12/1997 | Paston | |
| 5,737,811 | A | | 4/1998 | Rashid | |
| 6,701,589 | B1 | | 3/2004 | Kliewer | |

* cited by examiner

*Primary Examiner*—Robert J Sandy
(74) *Attorney, Agent, or Firm*—Edwards Angell Palmer & Dodge LLP

(57) ABSTRACT

A combined fastening device to be used in elements designed for lacing, such as pieces of clothing, footwear, and similar items. The device includes a main frame substantially filiform with a first end, to which a clamping part is assembled and fixed, and a second ring-shaped end, which is fastened to the clamping part. The device provides users with the possibility to customize and decorate their footwear, and at the same time prevents the accidents and problems caused by conventional shoelaces, preserving the users' physical wellbeing.

16 Claims, 5 Drawing Sheets

FOOTWEAR AND CLOTHES FASTENING AND TRANSFORMING SYSTEM

FIELD OF THE INVENTION

Figure 1:
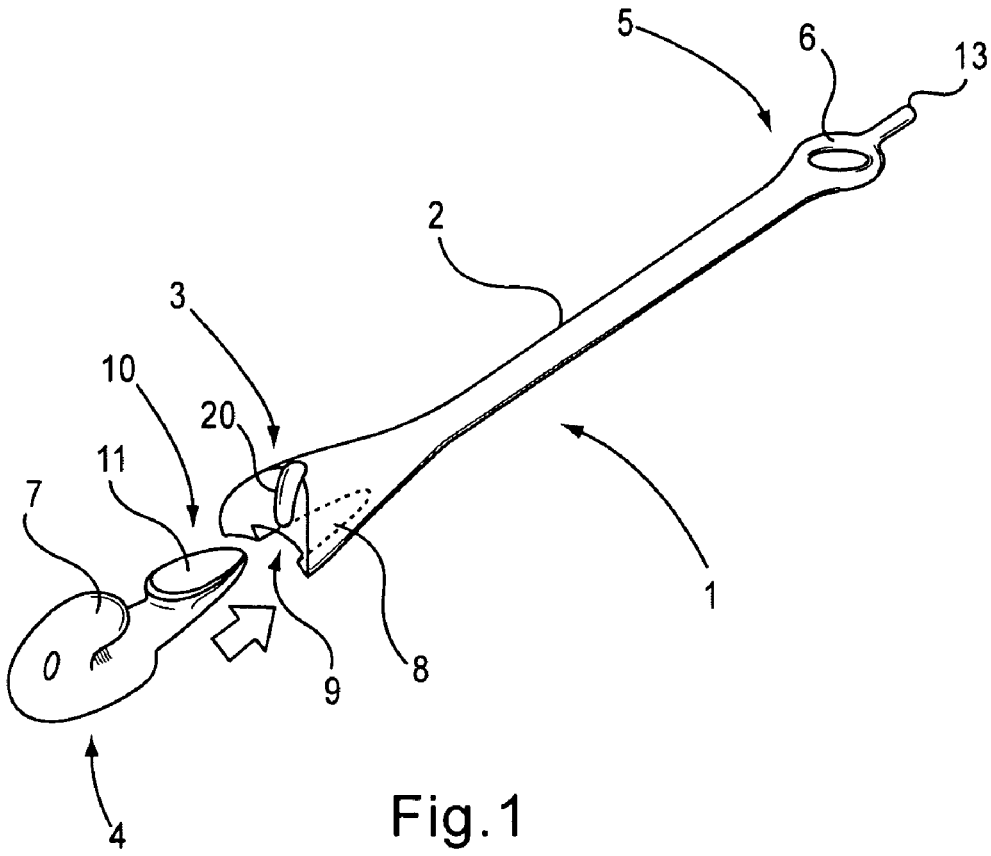

The present invention relates to unique devices for fastening shoes, clothes and purses. More specifically, the invention is concerned with attractive, simple and efficient means of fastening a shoe that is traditionally fastened by tying shoe laces. It allows to redesign a shoe constantly.

DETAILED DESCRIPTION

This invention is related to a combined fastening device to be used in elements designed for lacing, such as pieces of clothing, bags, etc. and specifically to replace shoelaces in walking shoes, athletic shoes, and similar.

Tying and fastening conventional shoelaces cause very well-known problems, since it is very uncomfortable to be continually tightening the knot as it unfastens or gets untied. To avoid this, the user usually does a double knot or bun, or tightens the laces too much, making the shoes uncomfortable or even harmful to the feet.

In the case of children's footwear, shoelaces get untied all the time owing to the children's continuous activity; this comprises potential risks for children: as the laces get loose and dirty in contact with the floor, they collect a number of toxic elements that, in turn, get in contact with the children's hands, posing the threat of causing infections or other harm; or even worse, there is the possibility of stepping on the loose shoelace ends and stumbling or falling down.

It is worth mentioning the case of handicapped, overweight and elderly people, who find it very difficult to fasten and unfasten shoelaces because of the physical dexterity this involves, and who may even fall and suffer injuries while trying to do so.

On the other hand, conventional shoelaces do not have ornamental characteristics to embellish brand new or used footwear, nor do they have additional pieces to supplement their use.

Therefore, this invention aims to provide a combined fastening device to be used in elements designed for lacing, such as pieces of clothing, footwear, and similar, a device that also gives the user the possibility to replace the common shoelaces with a safer fastening method, avoiding accidents and other harm.

This invention also aims to provide a combined fastening device to be used in elements designed for lacing, such as pieces of clothing, footwear, and similar, a device that allows the user to customize his/her footwear or piece of clothing choosing from different patterns.

Thus, this invention aims to provide a combined fastening device to be used in elements designed for lacing, such as pieces of clothing, footwear, and similar, a device that comprises a main frame that is substantially filiform with two ends: a first end to which a clamping part is assembled, and a second end that is ring-shaped to securely grasp the clamping part.

Figure 2:
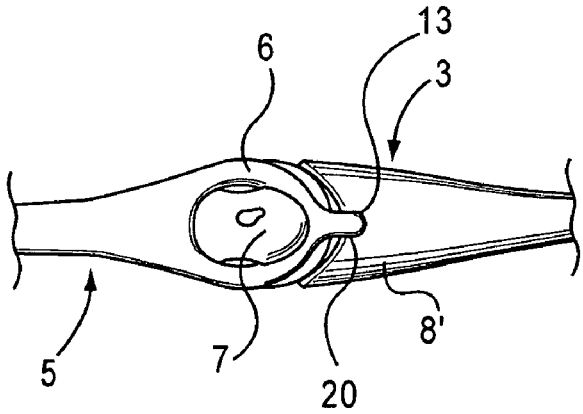
Figure 3:
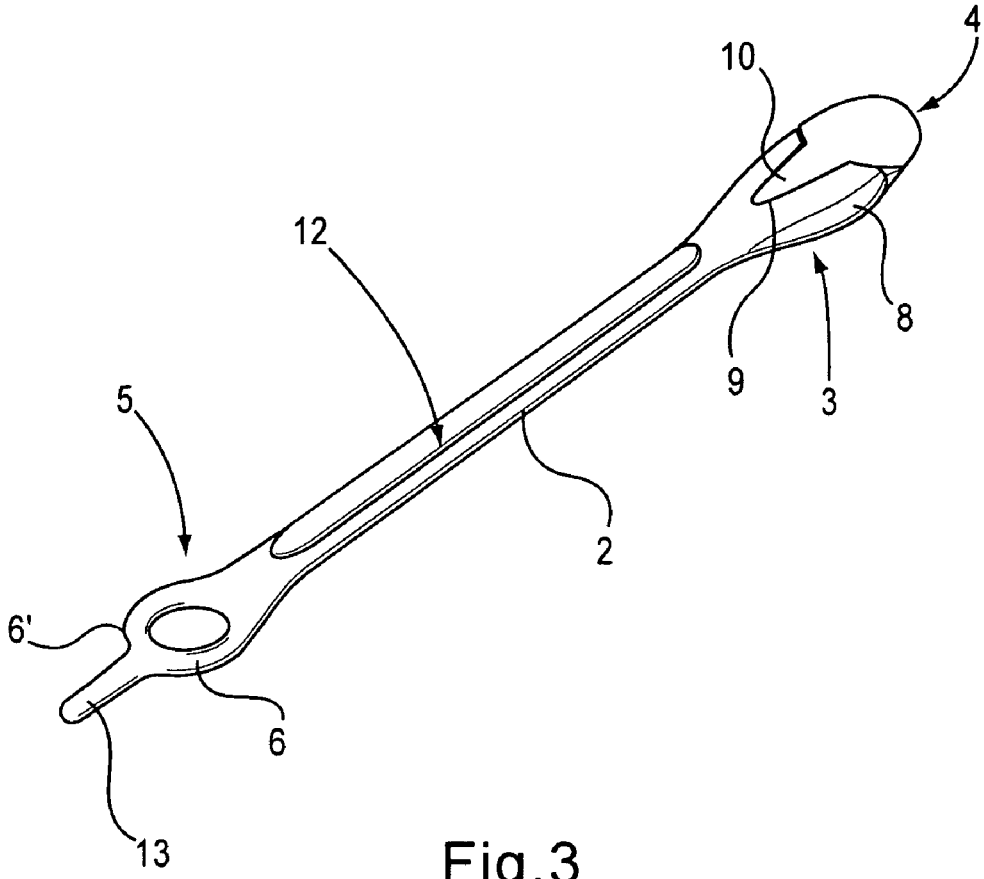
Figure 4:
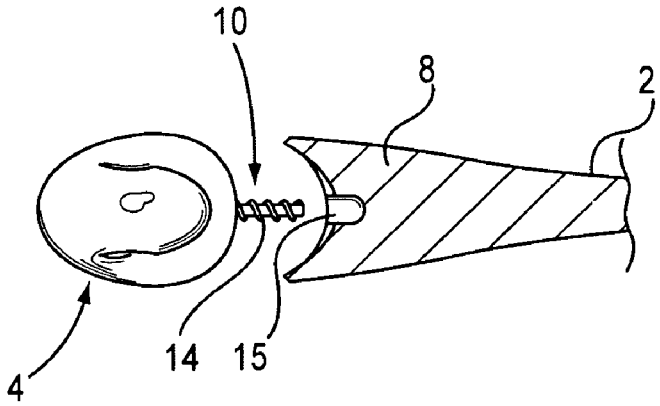
Figure 5:
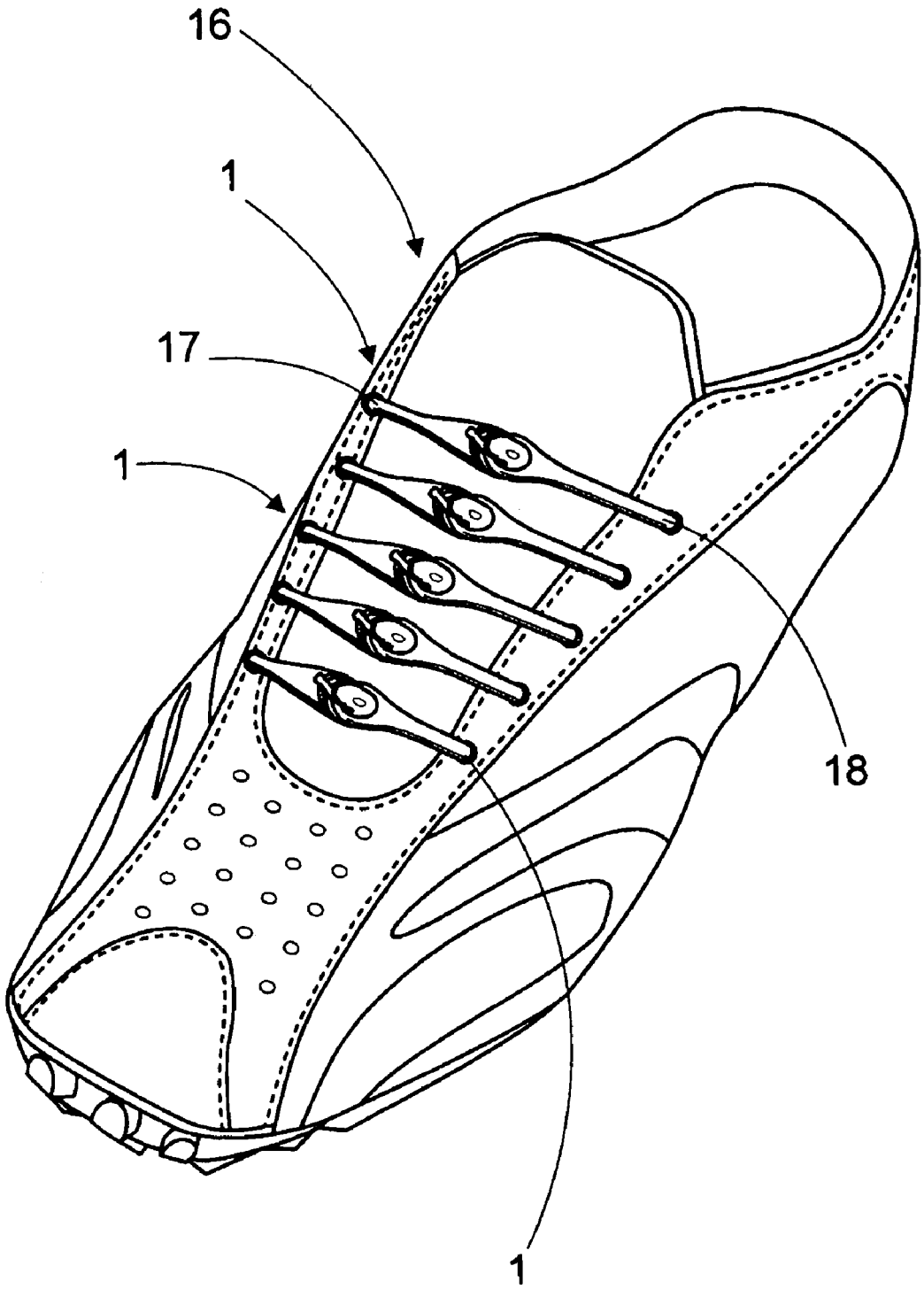
Figure 6:
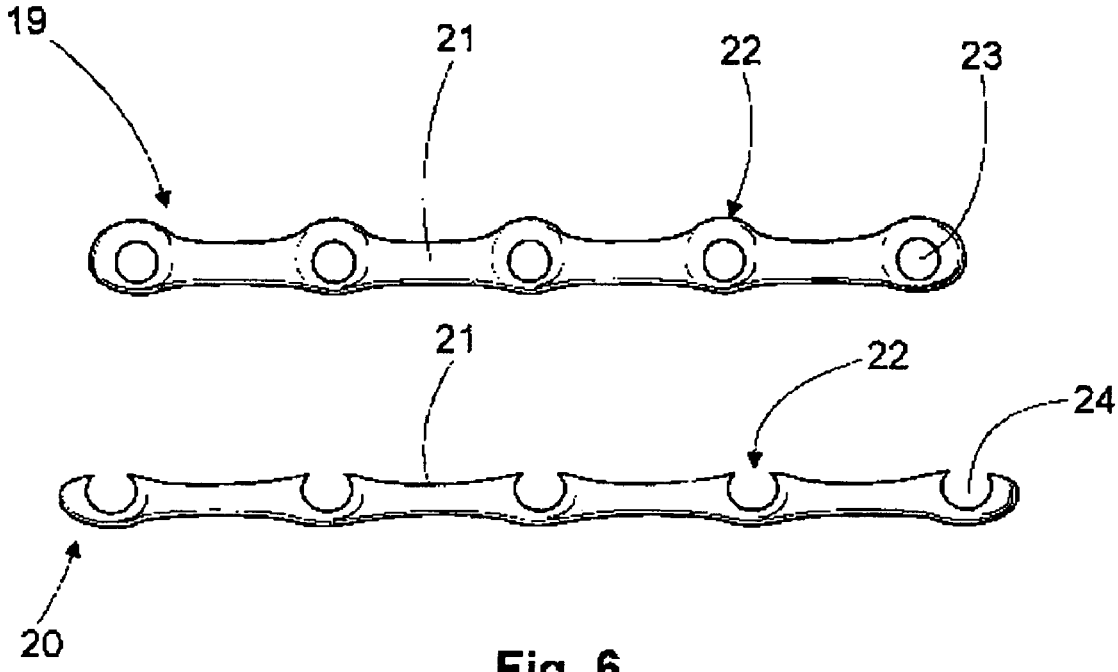

For a clearer and better understanding of the device of this invention, it has been illustrated in several figures attached hereto, which present a description of one of the preferred ways of carrying out this invention, only as an example. However, the intention is to cover all modifications and alternative constructions within the scope and spirit of this invention. The figures present the device as follows:

FIG. 1 presents a view in perspective of the device of this invention as it is disassembled;

FIG. 2 presents a front view that illustrates the closure method of the device in FIG. 1;

FIG. 3 presents a view in perspective of the underside of the device in FIG. 1, showing a groove for flexibility and softening of material;

FIG. 4 presents a combination front/cross-sectional view of an alternative assembly method of attaching the clamping part to the main frame;

FIG. 5 presents a view in perspective of a shoe designed for lacing using a plurality of the devices shown in FIG. 1;

FIG. 6 presents a front view of alternative fastening means; and

Figure 7:
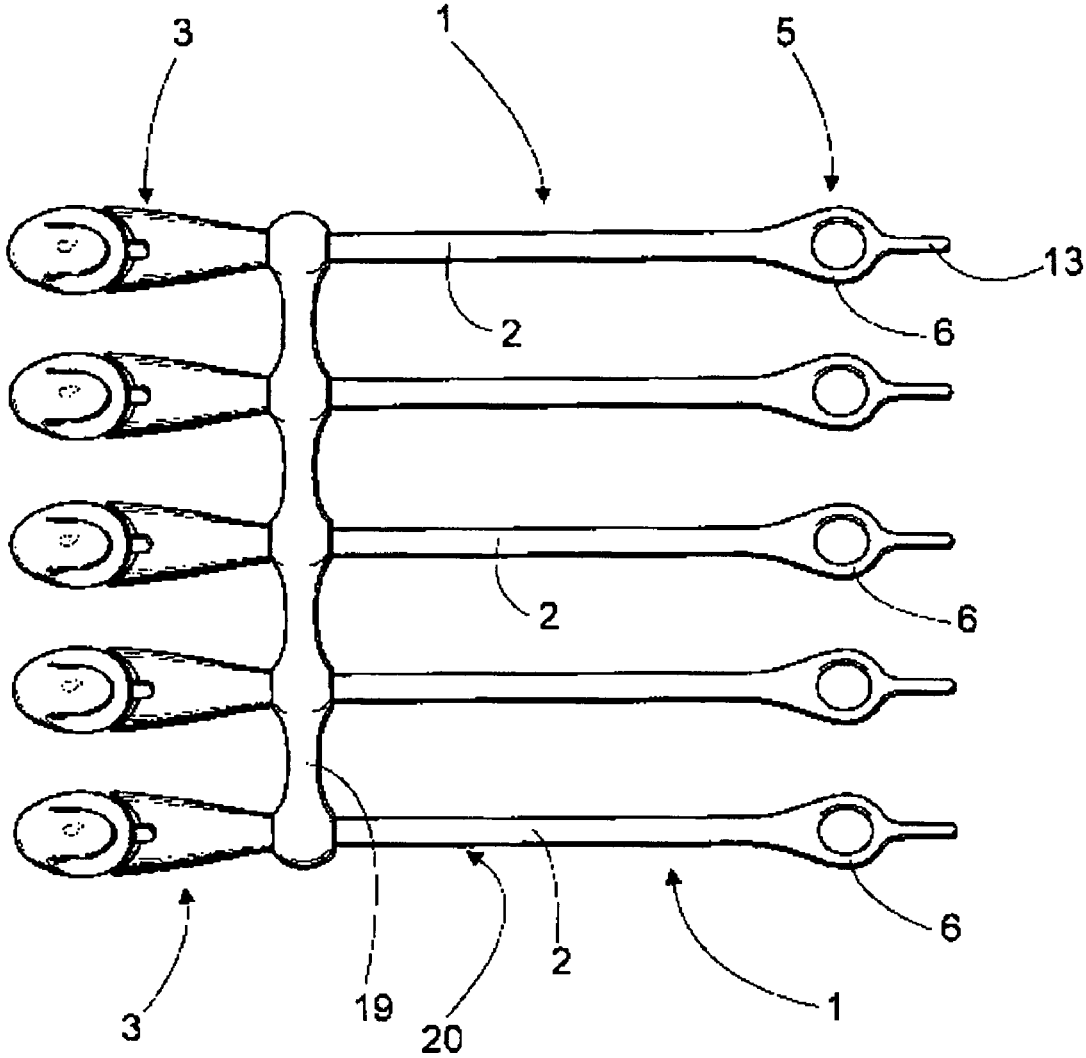

FIG. 7 presents a front view that illustrates the use of the fastening means to hold a plurality of adjacent devices together.

Referring now to FIG. 1, the combined fastening device is indicated with the general reference number 1, which comprises a main frame 2, substantially filiform, with a first end 3 to which a clamping part 4 is assembled, while the second end 5 of said main frame 2 is ring-shaped section 6. In this particular construction, the clamping part 4 comprises a hook 7 to grasp the ring-shaped section 6, as shown in FIG. 2.

FIG. 1 also shows how the clamping part is assembled and fixed to the first end 3 of the device 1. The first end 3 has a wider section 8, and in such section, a slot 9 for the assembly of an end 10 of the clamping part. As shown by the arrow, the assembly of the clamping part 4 to the main frame 2 is carried out by elastically adjusted coupling, in which said end 10 has a flange 11, which is compressed as it is inserted in the slot 9; the flange 11 regains its initial position as it reaches the end of the slot 9, fixing the clamping part 4 into place.

Referring to FIG. 3, the underside of the main frame 2 has a longitudinal groove 12, which makes the material softer and more flexible at the moment of inserting the device in the shoe eyelets, as explained herein below. It is also important to note how the clamping part 4 is coupled into the slot 9 of the first end 3 of the main frame 2. Also note that the second end 5, with the ring-shaped section 6, has a protrusion 13, which sticks out from the perimeter 6' of said ring-shaped section 6, defining an extreme insertion part, which rests in furrow 20 contained in first end 3 after insertion through ring-shaped section 6.

FIG. 4 presents an alternative method to assemble the clamping part 4 to the main frame 2. It shows how the end 10 is defined by a screw 14 which is screwed into the screw slot 15 in the middle of the wider section 8. This assembly method provides the user with the possibility to change the clamping part 4 quickly, according to his/her preference, since the clamping part can be made of plastic of different colors, or because of breakage of said clamping part 4.

FIG. 5 describes the application and use of the device 1 of this invention. Notice that parts included in other figures are mentioned herein below for a better understanding of the invention. The user takes a brand new or used shoe 16 of the kind that has a plurality of eyelets for the insertion of conventional shoelaces. The device 1 is applied as follows: the protrusion 13 is inserted into the corresponding eyelet 17, so that, once the protrusion 13 has been inserted, the ring-shaped section 16 loses shape and passes through the eyelet 17. Once the protrusion 13 and the ring-shaped section 6 have been inserted, the main frame 2 is passed over the tongue of the shoe to the second eyelet 18 of the pair, putting the first end 5 into place. The longitudinal groove 12 in the underside of the main frame 2 makes the material softer and more flexible, allowing the frame 2 to lose shape as it passes through the eyelet 17; this makes it very easy to insert the frame 2 smoothly into the eyelet 17.

After the device 1 has been passed over the tongue of the shoe to the second eyelet 18 of the pair, the protrusion 13 and the ring-shaped section 6 are inserted into this eyelet 18 as described herein above for eyelet 17. Once the main frame 2 has been passed through both eyelets (17 and 18), other devices 1 are applied as shown in FIG. 5. Once the devices are in place, the user can put on the shoe and proceed to fasten the ring-shaped section 6 of the device 1 to the hook 7 in the clamping part 4 as described in FIG. 2. FIG. 5 presents the shoe with the devices 1 applied.

As an option, fastening means 19 and 20, as shown in FIG. 6, may be applied to the devices 1. These fastening means 19 and 20 comprise a substantially cylindrical frame 21, which has a passage 22 for the main frame 2 of the device 1. In the fastening means 19 said passage 22 is defined by an orifice 23, whereas in the fastening means 20 the orifice 22 has an open section 24. The difference between the fastening means 19 and 20 is mainly due to the application they may have according to the user's preference, since they may be used passing the main frame 2 of the device 1 through the orifice 23 or applying the fastening means 20 directly onto the main frame 2, i.e. pressing the frame 2 into the fastening means 20. A clear example of the application of a fastening means 19 or 20 is provided in FIG. 7, which shows the fastening device to hold several devices 1 together. This allows all the devices 1 to be removed at once, making this procedure faster and easier.

It is also very important to highlight that the device 1 of this invention can be decorated with individual ornaments, whose application principle is similar to that of the fastening means 19 and 20. These ornaments can be modeled after flowers, balls or any kind of figure that users may choose to customize and decorate their footwear.

Therefore, the combined fastening device of this invention provides users with the possibility to customize and decorate their footwear, and at the same time prevents the accidents and problems caused by conventional shoelaces, preserving the users' physical wellbeing.

BACKGROUND AND RELATED ART

Besides traditional shoelaces, there have been inventions concerned with fastening footwear by various means.

One of this alternative shoe fastening device is described in U.S. Pat. No. 6,701,589 to Kliewer. Where a product whose main frame consists of a circular o-ring, reinforced rubber band, while the main frame of the invention described herein comprises an elastic filiform frame, with a groove along its underside, which makes the material more flexible and compressible to avoid crumples on its application and to facilitate threading the frame into the eyelets. The device of this invention comprises a needle-like protrusion on one of its ends to make it easier to thread the frame into the eyelet. Immediately after the needle-like protrusion, this device comprises a ring, which is part of the main frame and which is fastened to the clamping part assembled to the other end of the frame to provide the grasp and tension necessary for closure. The main frame has a slot that allows hiding the needle-like protrusion after both ends of the main frame have been fastened. The patent U.S. Pat. No. 6,701,589 to Kliewer does not comprise any method to facilitate its threading into the eyelets, nor does it have any special feature to preserve the original shape of the product.

The patent U.S. Pat. No. 6,701,589 to Kliewer comprises two independent parts while the invention described herein is a one-piece element—an inseparable unit—although an alternative device with interchangeable clamping parts can be commercialized, which is distinct from the double sided clip hook that is the basis of the Kliewer patent.

Unlike the patent U.S. Pat. No. 6,701,589 to Kliewer, this invention is a closure system, consisting of different continuous and discontinuous links that assemble the independent sections of the basic configuration, completely changing footwear and providing the possibility to manipulate all the independent sections as a whole unit.

Unlike the identification tags mentioned in the patent U.S. Pat. No. 6,701,589 to Kliewer, the fantasy ornaments of this invention can not only be applied to an eyelet pair, but also integrate one, two or several independent sections; thanks to the unlimited possibilities of these ornaments, they are not limited to the user's identification, but provide the possibility to decorate the footwear and pieces of clothing to which they are applied.

U.S. Pat. No. 3,731,350 to Diebold describes a lace tensioning device. The invention disclosed herein describes a way to completely avoid the use of shoelaces in any form.

Several Patents have previously addressed footwear fastening in the last century, but none of the prior art has solved this issue in the same way that is described herein.

What is claimed is:

1. A combined fastening device to be used in an item designed for lacing comprising:

a main frame substantially filiform having a first end and a second ring-shaped end; and a clamping part having a hook attached to the first end of the main frame, wherein the second ring-shaped end of the main frame is fastenable to the hook of the clamping part.

2. The device according to claim 1, wherein said clamping part is detachably assembled to the first end of the main frame.

3. The device according to claim 2, wherein said first end includes a wider section to which said clamping part is assembled.

4. The device according to claim 3, further comprising a slot arranged in said wider part to assemble and fix the clamping part.

5. The device according to claim 3, further comprising a screw slot contained in said wider section, wherein the end of the clamping part contains a screw.

6. The device according to claim 5, wherein assembly of the clamping part to the first end of the main frame is carried out by screwing the clamping part end into the screw slot contained in the wider section of the first end.

7. The device according to claim 2, wherein assembly of the clamping part to the first end is carried out by elastically adjusted coupling of the clamping part end to the wider section of the first end.

8. The device according to claim 1, wherein said ring-shaped end presents a protrusion, which sticks out from the perimeter of said ring-shaped end, defining an extreme insertion part.

9. The device according to claim 8, wherein the first end has a furrow running across an end face thereof for containing said protrusion after said protrusion is inserted through said second ring-shaped end.

10. The device according to claim 1, further comprising a groove arranged along a longitudinal direction on an underside of a middle portion of the main frame for softening and providing flexibility of the material.

11. The device according to claim 1, further comprising at least one fastening means of at least one pair of main frames adjacently placed.

12. The device according to claim 11, wherein said fastening means comprises a substantially cylindrical frame, which presents a passage for the at least one pair of main frames of the combined fastening device.

13. The device according to claim 12, wherein said passage is defined by an orifice.

14. The device according to claim 13, wherein said orifice presents an open section.

15. The device according to claim 1, wherein said item comprises a piece of clothing.

16. The device according to claim 1, wherein said item comprises footwear.

* * * * *